US007569011B2

(12) United States Patent
Matsumoto

(10) Patent No.: US 7,569,011 B2
(45) Date of Patent: Aug. 4, 2009

(54) IMAGE FORMING APPARATUS, POST-PROCESSING APPARATUS, IMAGE FORMING METHOD, POST-PROCESSING METHOD, COMPUTER READABLE MEDIUM FOR FORMING AN IMAGE, AND COMPUTER READABLE MEDIUM FOR THE POST-PROCESSING

(75) Inventor: Masashi Matsumoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/476,656

(22) Filed: Jun. 29, 2006

(65) Prior Publication Data

US 2007/0135288 A1 Jun. 14, 2007

(30) Foreign Application Priority Data

Dec. 14, 2005 (JP) ..... P2005-359979

(51) Int. Cl.
*B31B 1/36* (2006.01)
*G03G 15/01* (2006.01)

(52) U.S. Cl. ..... 493/459; 493/460; 399/405

(58) Field of Classification Search ..... 493/459, 493/460; 399/405–407
See application file for complete search history.

(56) References Cited

U.S. PATENT DOCUMENTS

| | | | | |
|---|---|---|---|---|
| 6,165,665 | A * | 12/2000 | Ishihara | 430/110.2 |
| 6,171,225 | B1 * | 1/2001 | Nonoyama et al. | 493/16 |
| RE39,517 | E * | 3/2007 | Ishihara | 430/110.2 |
| 7,383,017 | B2 * | 6/2008 | Ushio | 399/406 |
| 2005/0220520 | A1 * | 10/2005 | Kawamoto | 399/405 |
| 2006/0018694 | A1 * | 1/2006 | Hayashi | 399/406 |
| 2006/0038685 | A1 * | 2/2006 | Kiwada et al. | 340/572.1 |
| 2006/0088331 | A1 * | 4/2006 | Inoue et al. | 399/81 |

FOREIGN PATENT DOCUMENTS

JP 5-309971 11/1993

* cited by examiner

*Primary Examiner*—Hemant M Desai
(74) *Attorney, Agent, or Firm*—Morgan, Lewis & Bockius LLP

(57) ABSTRACT

An image forming apparatus includes an image forming unit that forms an image on a sheet; a curling unit that curls the sheet on which the image is formed; a sheet folding unit that performs a folding process for the sheet on which the image is formed; and a control unit that controls an operation of the curling unit and the sheet folding unit so that the sheet is substantially curled in a first direction to be folded.

12 Claims, 11 Drawing Sheets a b

IMAGE FORMING APPARATUS, POST-PROCESSING APPARATUS, IMAGE FORMING METHOD, POST-PROCESSING METHOD, COMPUTER READABLE MEDIUM FOR FORMING AN IMAGE, AND COMPUTER READABLE MEDIUM FOR THE POST-PROCESSING

The present invention relates to an image forming apparatus, a post-processing apparatus, an image forming method and a post-processing method, a computer readable medium for forming an image, a computer readable medium for a post-processing, in which a folding process is performed for the sheet.

BACKGROUND

Description of Related Art

Some image forming apparatuses such as copying machine, printer and multifunction machine or affiliated post-processing apparatuses comprise a sheet folding unit for performing a folding process for the sheet delivered from the image forming apparatus main body. A sheet folding process is mainly divided into two-fold, three-fold and Z-fold. The two-fold involves folding the sheet in half the original size. The three-fold involves folding the sheet in one-third the original size. The three-fold includes an inner three-fold for folding the sheet in three inwardly and an outer three-fold for folding the sheet in three outwardly. This three-fold is mostly employed in receiving the sheet in an envelope, and also called an envelope-fold.

On the contrary, Z-fold involves folding the sheet in three in half the original size. Specifically, the entire sheet is folded in the shape of Z character by creasing the sheet at a position of one-fourth the original sheet length L and a position of half the original sheet length from the sheet end on the downstream side in a sheet conveying direction, as shown in FIG. 11. Therefore, if the sheet of A3 horizontal size is Z-folded, it is the same size as the sheet of A4 vertical size. Also, if the sheet of B4 horizontal size is Z-folded, it is the same size as the sheet of B5 vertical size. Therefore, Z-fold is used when the sheet of A3 horizontal size is outputted in the same size as the sheet of A4 vertical size, or when the sheet of B4 horizontal size is outputted in the same size as the sheet of B5 vertical size. The Z-folded sheet (hereinafter referred to as "Z-fold sheet") is finally outputted onto a sheet stack tray. In this case, if a great number of Z-fold sheets are outputted in one job, the great number of Z-fold sheets are stacked on the sheet stack tray.

The Z-fold sheet has a folded part in the shape of Z-character, as shown in FIG. 11. Therefore, if the great number of Z-fold sheets S are stacked on the sheet stack tray T for outputting the sheet, the stack form of all the sheets is swollen like a cone due to a bulge of the folded part of each of the Z-fold sheets S, as shown in FIG. 12. Accordingly, if the sheets continue to be stacked in the bulged shape, the sheets collapse by a bulge of the folded part and buckling due to dead weight when reaching a certain stack height, thereby closing a sheet output opening and making it impossible to output (stack) the subsequent sheets onto the sheet stack tray.

SUMMARY

The present invention has been made in view of the above circumstances and provides an image forming apparatus, a post-processing apparatus, an image forming method and a post-processing method.

According to an aspect of the invention, there is provided an image forming apparatus including; an image forming unit that forms an image on a sheet; a curling unit that curls the sheet on which the image is formed; a sheet folding unit that performs a folding process for the sheet on which the image is formed; and a control unit that controls an operation of the curling unit and the sheet folding unit so that the sheet is substantially curled in a first direction to be folded.

BRIEF DESCRIPTION OF THE DRAWINGS

Embodiments of the present invention will be described in detail based on the following figures, wherein.

DESCRIPTION OF EXEMPLARY EMBODIMENTS

Embodiments of the present invention will be described below in detail with reference to the drawings.

Figure 1:
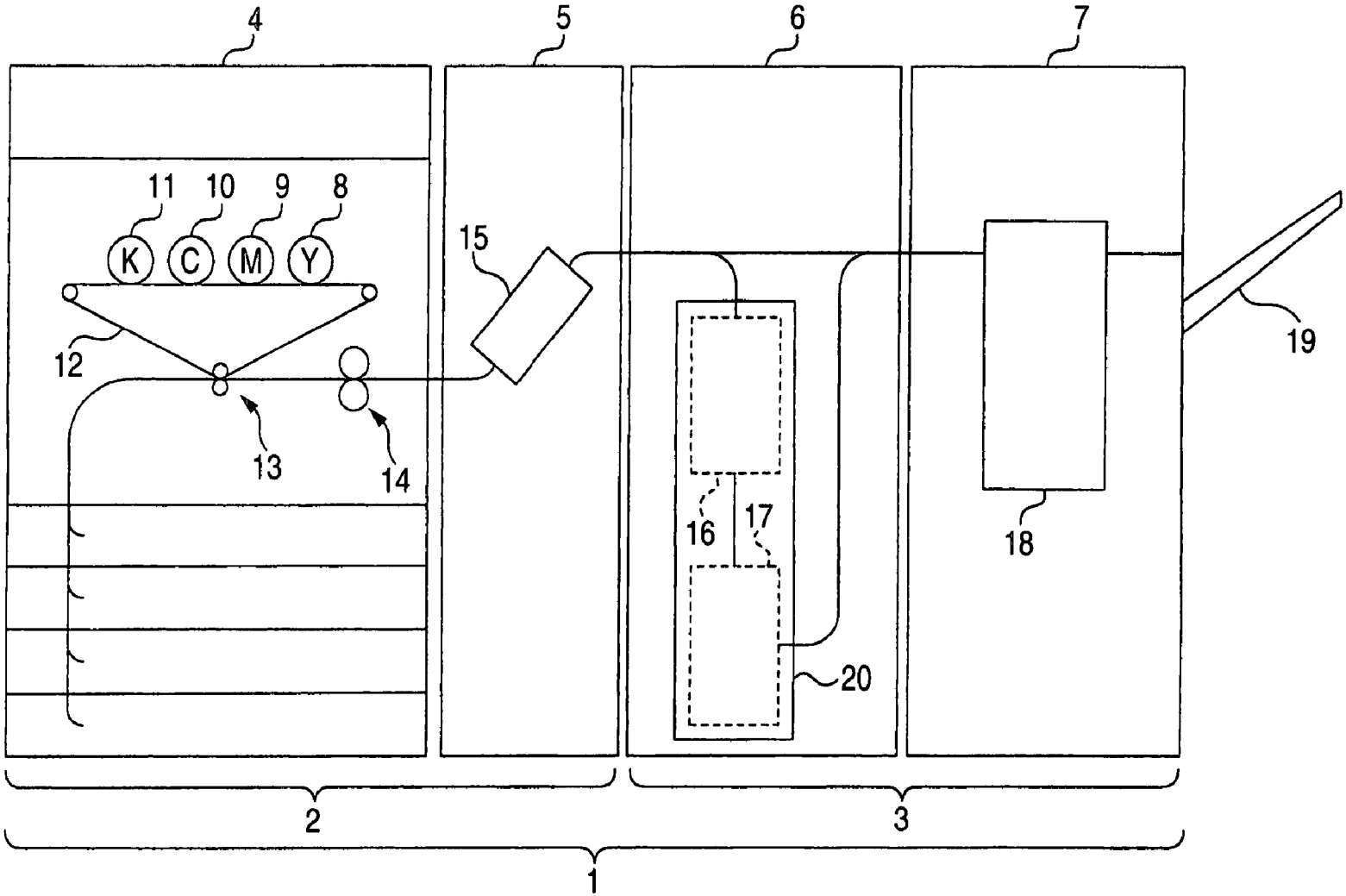
FIG. 1 is a schematic view showing a constitution example of an image forming apparatus according to an embodiment.

FIG. 1 is a schematic view showing a constitution example of an image forming apparatus according to an embodiment. In FIG. 1, the image forming apparatus 1 is largely composed of an image forming apparatus main body 2 and a post-processing apparatus main body 3. Also, the image forming apparatus main body 2 is composed of an image forming unit 4 and a connection unit 5, and the post-processing apparatus mainbody 3 is composed of a former stage post-processing unit 6 and a latter stage post-processing unit 7.

The image forming unit 4 forms the image on the sheet supplied from a sheet supply tray, based on an electrophotographic method, for example. More particularly, the image forming unit 4 comprises an image reader (e.g., image scanner) for optically reading the original image, and prints the image data-of the original read by this image reader as a visible image on the sheet. The image forming unit 4 has a machine constitution of four tandem type having four photosensitive drums 8, 9, 10 and 11 corresponding to four colors of yellow (Y), magenta (M), cyan (C) and black (K), for example.

In the above machine constitution, when a full-color image is formed on the sheet, the toner image of each color of YMCK is formed on the surface of each of four photosensitive drums 8 to 11 by charging, exposure, and development, and the toner image of each color is transferred (primary transfer) in order from each of the photosensitive drums 8 to 11 onto an intermediate transfer body 12 like an endless belt, so that the full-color toner image is formed on the intermediate transfer body 12. Thereafter, the toner images are collectively transferred (secondary transfer) onto the sheet by a transfer unit 13 provided on a transit passage of the intermediate transfer body 12, and then the toner is fixed on the surface of the sheet by the fixing unit 14. Also, when the white and black image is formed on the sheet, the toner image of K color is formed on the surface of the photosensitive drum 11 by charging, exposure and development, and this toner image is transferred from the photosensitive drum 11 onto the intermediate transfer body 12, from which the toner image is transferred onto the sheet by the transfer unit 13 and fixed by the fixing unit 14. Thus, the sheet on which the image is formed is fed from the image forming unit 4 to the connection unit 5.

The connection unit 5 connects the image forming apparatus main body 2 and the post-processing apparatus main body 3, and the sheet fed from the image forming unit 4 is passed to the former stage post-processing unit 6. The connection unit 5 has a sheet conveying passage for passing the sheet. The sheet conveying passage of the connection unit 5 is formed to connect an exit part (sheet output port) of the sheet conveying passage in the image forming unit 4 and an entrance part (sheet intake port) of the sheet conveying passage in the former stage post-processing unit 6. Also, the curling mechanism 15 is provided on the course of the sheet conveying passage in the connection unit 5. The curling mechanism 15 curls the sheet conveyed through the connection unit 5.

Figure 11:
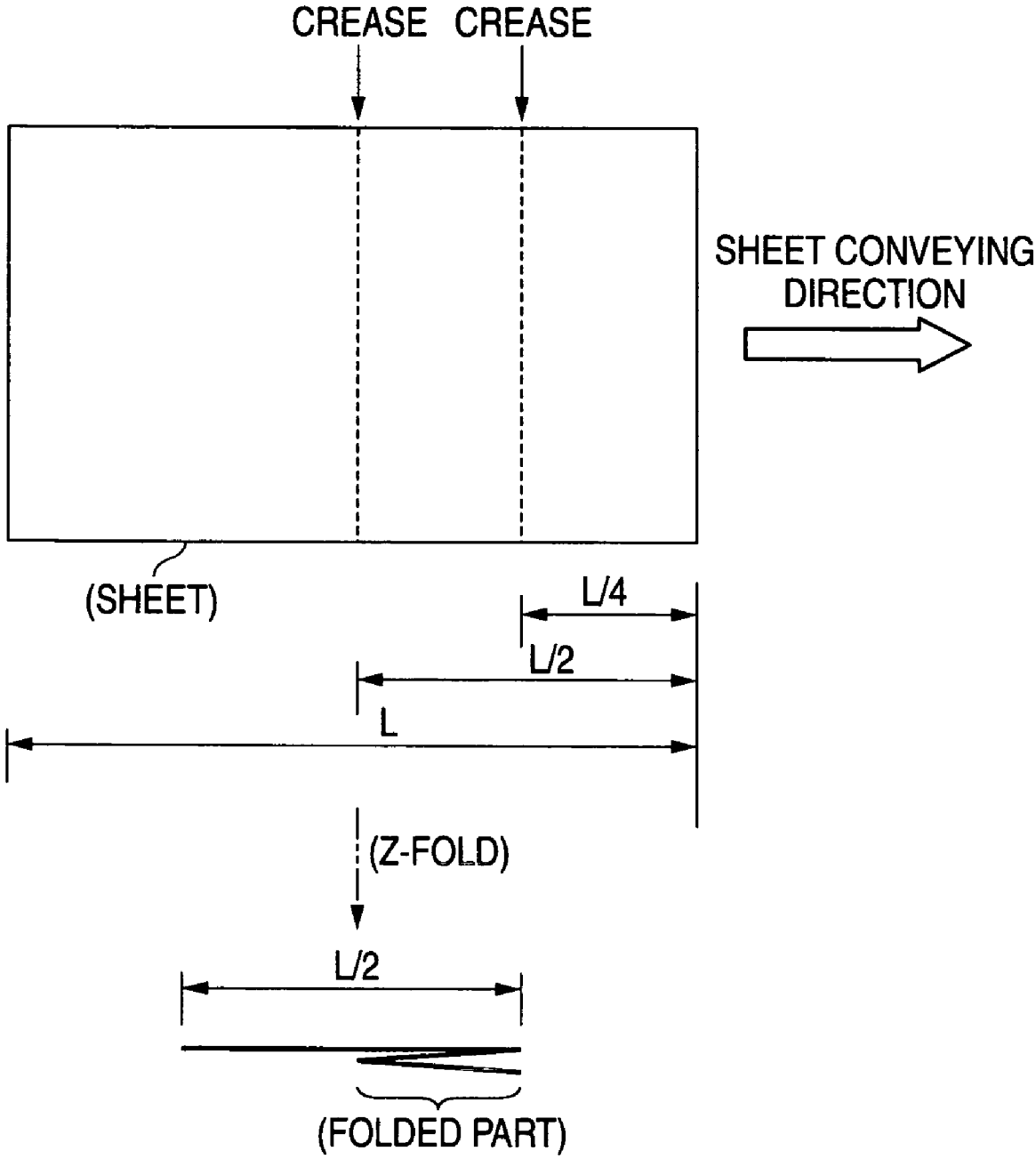
FIG. 11 is a view for explaining a Z-fold of the sheet.
Figure 12:
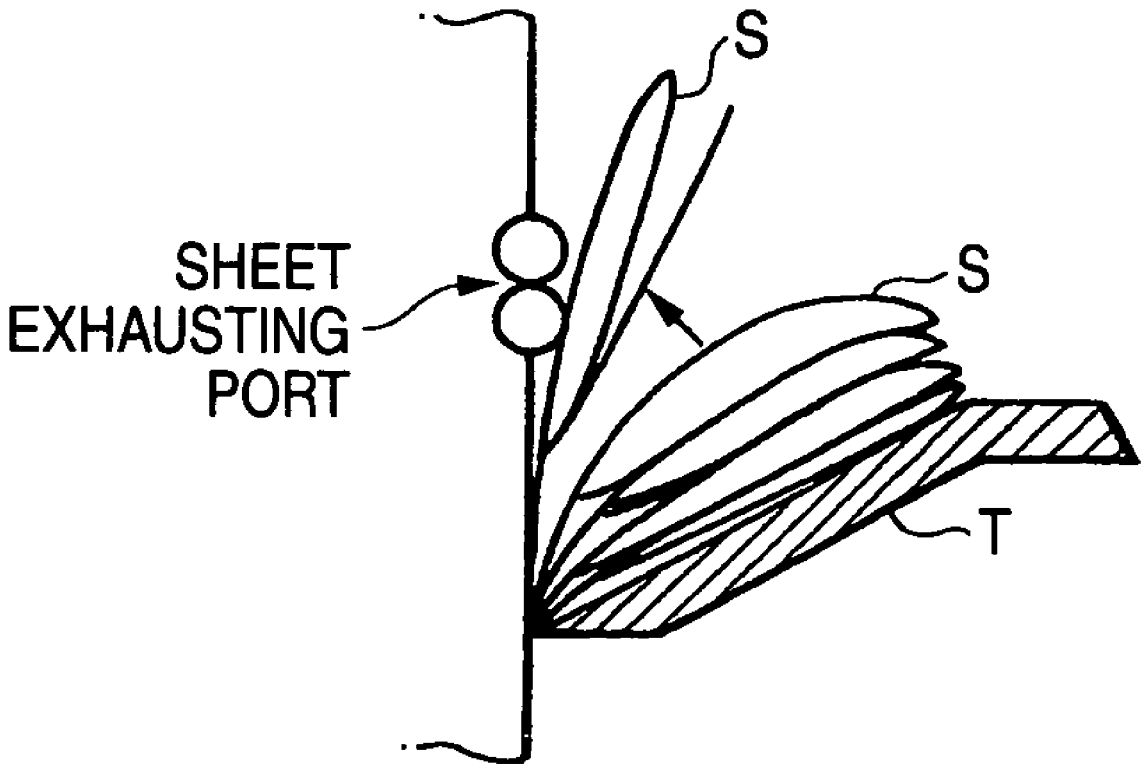
FIG. 12 is a view for explaining a stack form of the sheets due to the Z-fold as shown in FIG. 11.

The former stage post-processing unit 6 comprises a sheet folding mechanism 20 composed of a first sheet folding part 16 and a second sheet folding part 17, besides the sheet conveying passage. The sheet folding mechanism 20 performs a folding process for the sheet. More particularly, the sheet folding mechanism 20 Z-folds the sheet (see FIG. 11) as the sheet folding process. The first sheet folding part 16 folds the sheet conveyed through the former stage post-processing unit 6 at a first crease position. The second sheet folding part 17 folds the sheet conveyed through the former stage post-processing unit 6 at a second crease position different from the first crease position. The first sheet folding part 16 is disposed on the upstream side of the second sheet folding part 17 in the sheet conveying direction. Therefore, when the folding process is performed for the sheet in the sheet folding mechanism 20, the first sheet folding part 16 folds the sheet at the first crease position, and then the second sheet folding part 17 folds the sheet at the second crease position.

The latter stage post-processing unit 7 comprises a post-processing mechanism 18 for performing a post-processing other than the folding process for the sheet sent out of the former stage post-processing unit 6 and an exhausting roll (sheet exhausting roll), not shown, for exhausting the sheet on the sheet stack tray 19. The post-processing mechanism 18 performs a staple process (binding process) or a punching process (boring process), for example, as the post-processing other than the folding process. The staple process involves binding a plurality of sheets by driving a staple into them. The punching process involves opening a hole in the sheet by punching. The sheet stack tray 19 is the tray onto which the sheet conveyed through the post-processing apparatus main body 3 is finally outputted. The sheet stack tray 19 is provided to be able to rise or fall on one side of the post-processing unit 7. The rise or fall operation of the sheet stack tray 19 is controlled depending on the stack amount (number) or stack height of sheets outputted onto the sheet stack tray 19. The sheet outputted onto the sheet stack tray 19 has been post-processed by the former stage post-processing unit 6 and the latter stage post-processing unit 7 in accordance with an instruction from the user, as needed.

Figures 2, 3A, 3B:
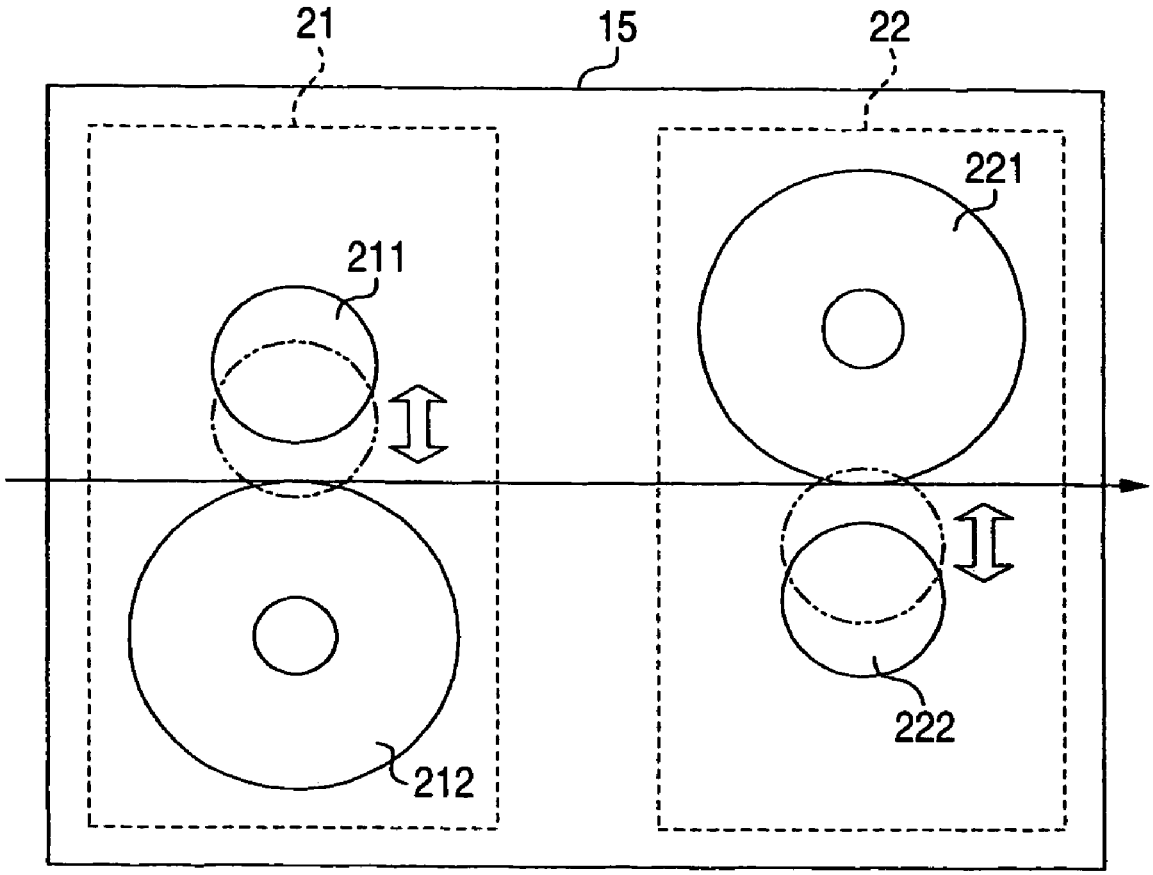
FIG. 2 is a view showing a constitution example of a curling mechanism according to the embodiment.
FIGS. 3A and 3B are views for explaining a difference in the curling direction according to the embodiment.

FIG. 2 is a view showing a specific constitution example of the curling mechanism 15. The curling mechanism 15 is composed of a first curling part 21 and a second curling part 22. The first curling part 21 is disposed on the upstream side and the second curling part 22 is disposed on the downstream side in the sheet conveying direction as indicated by the arrow in FIG. 2. Their positional relationship maybe reversed. The first curling part 21 and the second curling part 22 curl the sheet in the mutually opposite convex and concave relation. That is, the first curling part 21 curls the sheet in the first direction, whereas the second curling part 22 curls the sheet in the second direction. The first direction is the direction in which the curl on the sheet curled by the first curling part 21 substantially has the lower convex shape when the sheet is outputted onto the sheet stack tray 19. The second direction is the direction in which the curl on the sheet curled by the second curling part 22 substantially has the upper convex shape when the sheet is outputted onto the sheet stack tray 19.

The first curling part 21 is made using a pair of upper and lower pressure rolls 211, 212. The upper pressure roll 211 is made of a material having high hardness such as metal or hard plastic. Also, the upper pressure roll 211 is provided movably in the direction making or losing contact with (approaching or separating from) the lower pressure roll 212 by a roll moving mechanism, not shown. The lower pressure roll 212 is made of an adequately elastically deformable material such as rubber or sponge. The lower pressure roll 212 has a larger roll diameter than the upper pressure roll 211. Also, the pair of pressure rolls 211, 212 are provided rotatably in a mutually pressed (nipped) state, in which the lower pressure roll 212 is a driving roll and the upper pressure roll 211 is a driven roll.

The second curling part 22 is made using a pair of upper and lower pressure rolls 221, 222. The upper pressure roll 221 has the same roll configuration as the lower pressure roll 212, and the lower pressure roll 222 has the same roll configuration as the upper pressure roll 211. That is, the first curling part 21 and the second curling part 22 are in the mutually reversed positional relationship between one pair of upper and lower pressure rolls.

In the curling mechanism 15 with the above configuration, for example, if the upper pressure roll 211 is pressed against the lower pressure roll 212 in the first curling part 21, a nip part is formed in a pressure contact part between the pressure rolls 211, 212. In this nip part, a part of the lower pressure roll 212 is elastically deformed along the outer peripheral shape of the upper pressure roll 211. In this state, the sheet is passed through the first curling part 21, whereby the sheet is pressed downward by the upper pressure roll 211 and curled. Therefore, the sheet is substantially curled in the lower convex shape, as shown in FIG. 3A.

On the other hand, if the lower pressure roll 222 is pressed against the upper pressure roll 221 in the second curling part 22, a nip part is formed in a pressure contact part between the pressure rolls 221, 222. In this nip part, a part of the upper pressure roll 221 is elastically deformed along the outer peripheral shape of the lower pressure roll 222. In this state, the sheet is passed through the second curling part 22, whereby the sheet is pressed upward by the lower pressure roll 222 and curled. Therefore, the sheet is substantially curled in the upper convex shape, as shown in FIG. 3B.

As seen from the above, the curling mechanism 15 can take four operation states. The first operation state is the state where the upper pressure roll 211 is pressed against the lower pressure roll 212 in the first curling part 21, and the lower pressure roll 222 is separated from the upper pressure roll 221 in the second curling part 22. In the first operation state, the sheet is curled by the first curling part 21 alone. Therefore, the sheet passed through the curling mechanism 15 is substantially curled in the lower convex shape.

The second operation state is the state where the upper pressure roll 211 is separated from the-lower pressure roll 212 in the first curling part 21, and the lower pressure roll 222 is pressed against the upper pressure roll 221 in the second curling part 22. In the second operation state, the sheet is curled by the second curling part 22 alone. Therefore, the sheet passed through the curling mechanism 15 is substantially curled in the upper convex shape.

The third operation state is the state where the upper pressure roll 211 is pressed against the lower pressure roll 212 in the first curling part 21, and the lower pressure roll 222 is pressed against the upper pressure roll 221 in the second curling part 22. In the third operation state, the sheet is curled by both the first curling part 21 and the second curling part 22. Therefore, the sheet passed through the curling mechanism 15 is curled in the vertically opposite directions by the first curling part 21 and the second curling part 22. As a result, the curl of the sheet is removed.

The fourth operation state is the state where the upper pressure roll 211 is separated from the lower pressure roll 212 in the first curling part 21, and the lower pressure roll 222 is separated from the upper pressure roll 221 in the second curling part 22. In the fourth operation state, neither the first curling part 21 nor the second curling part 22 curls the sheet. Therefore, the sheet passed through the curling mechanism 15 is conveyed in its original condition.

Figure 4:
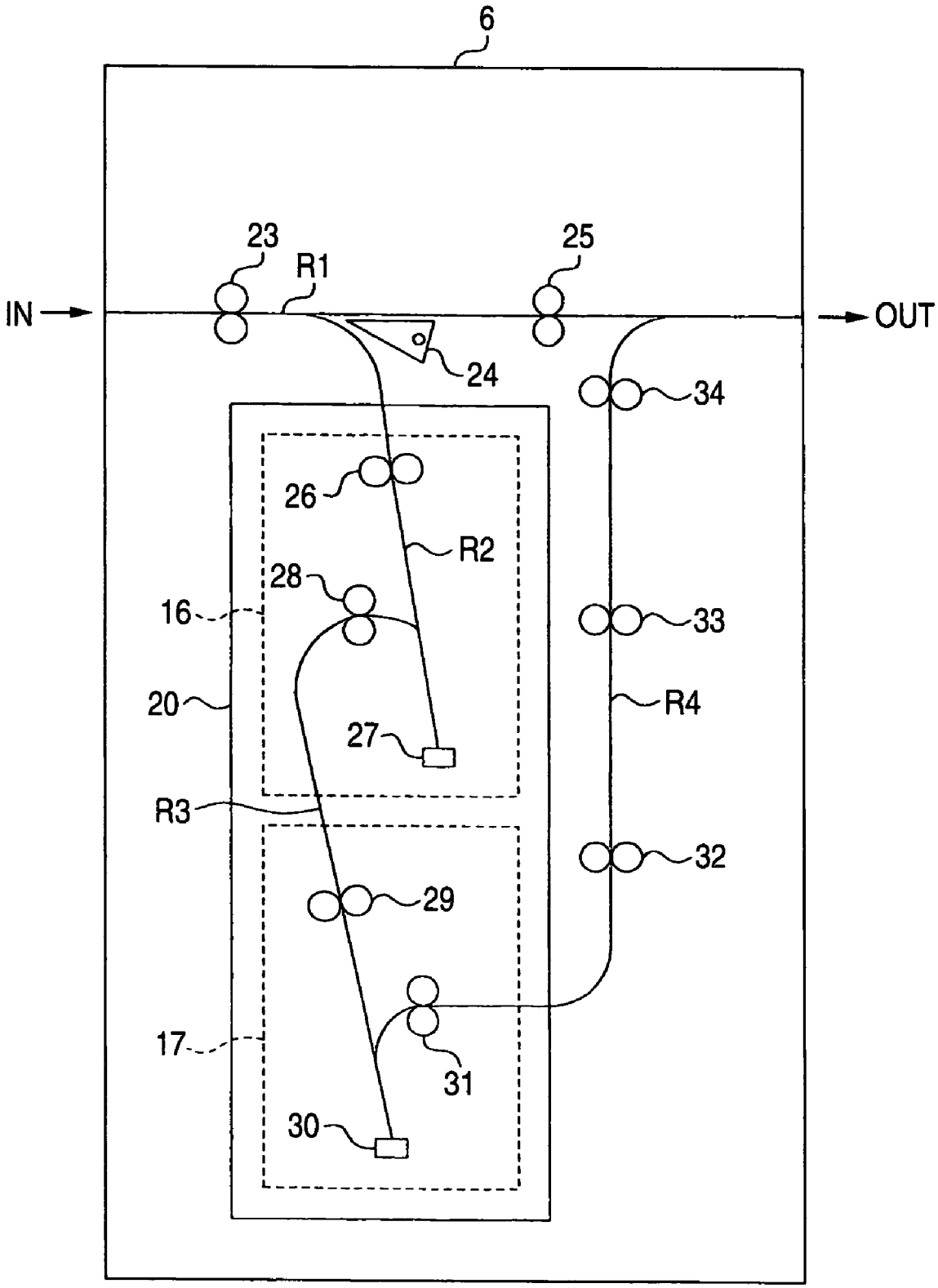
FIG. 4 is a view showing a constitution example of a former stage post-processing unit including a sheet folding mechanism according to the embodiment.

FIG. 4 is a view showing a specific constitution example of the former stage post-processing unit 6 comprising the sheet folding mechanism 20. The former stage post-processing unit 6 is formed with a first sheet conveying passage R1, a second sheet conveying passage R2, a third sheet conveying passage R3 and a fourth sheet conveying passage R4. The first sheet conveying passage R1 is formed in a substantially horizontal condition (on the straight line). The second sheet conveying passage R2 is formed to branch from near an entrance of the first sheet conveying passage R1 downward. The third sheet conveying passage R3 is formed to branch from a midpoint on the second sheet conveying passage R2 further downward. The fourth sheet conveying passage R4 is formed to branch from a midpoint on the third sheet conveying passage R3 upward. Also, a trailing edge of the fourth sheet conveying passage R4 joins midway near an exit of the first sheet conveying passage R1.

The first sheet conveying passage R1 is provided with the conveying rolls 23, a switching gate 24 and the conveying rolls 25 in order from the upstream side to the downstream side in the sheet conveying direction. The conveying rolls 23, 25 nip and convey the sheet at respective positions. The switching gate 24 switches the sheet advancing direction in a branch part between the first sheet conveying passage R1 and the second sheet conveying passage R2. The switching gate 24 is turned on or off by a driving unit (solenoid), not shown, in which the sheet advancing direction is guided toward-the second sheet conveying passage R2 in the branch part in the on state, while the sheet advancing direction is guided toward the first sheet conveying passage R1 in the branch part in the off state. Accordingly, if the switching gate 24 is turned on, the sheet fed from the connection unit 5 into the former stage post-processing unit 6 is led from the first sheet conveying passage R1 to the second sheet conveying passage R2. Also, if the switching gate 24 is turned off, the sheet fed from the connection unit 5 into the former stage post-processing unit 6 is conveyed horizontally along the first sheet conveying passage R1.

The second sheet conveying passage R2 is provided with the push-in rolls 26 and a stopper 27 in order from the upstream side to the downstream side in the sheet conveying direction. The push-in rolls 26 push the sheet in one direction on the second sheet conveying passage R2 while nipping it. The stopper 27 stops the leading edge of the sheet on the second sheet conveying passage R2 to regulate the moving trailing edge of the sheet. The stopper 27 is provided to be movable in the sheet conveying direction on the second sheet conveying passage R2 to adjust (vary) the crease position of the sheet in accordance with the sheet size.

The third sheet conveying passage R3 is provided with the folding rolls 28, the push-in rolls 29 and a stopper 30 in order from the upstream side to the downstream side in the sheet conveying direction. The folding rolls 28 fold the sheet on the third sheet conveying passage R3. The push-in rolls 29 push the sheet in one direction on the third sheet conveying passage R3. The stopper 30 stops the leading edge of the sheet on the third sheet conveying passage R3 to regulate the moving trailing edge of the sheet. The stopper 30 is provided to be movable in the sheet conveying direction on the third sheet conveying passage R3 to adjust (vary) the crease position of the sheet in accordance with the sheet size.

The fourth sheet conveying passage R4 is provided with the folding rolls 31 and the conveying rolls 32 to 34 in order from the upstream side to the downstream side in the sheet conveying direction. The folding rolls 31 fold the sheet on the fourth sheet conveying passage R4. The conveying rolls 32 to 34 convey the sheet while nipping it at respective positions.

In the former stage post-processing unit 6 with the above constitution, the first sheet folding part 16 is made using the push-in rolls 26, the stopper 27 and the folding rolls 28, and the second sheet folding part 17 is made using the push-in rolls 29, the stopper 30 and the folding rolls 31. And the sheet not subjected to the folding process is conveyed substantially horizontally (straightly) along the first sheet conveying passage R1, while the sheet subjected to the folding process. (Z-fold) is fed from the first sheet conveying passage R1 into the second sheet conveying passage R2 via the switching gate 24, and returned from there via the third sheet conveying passage R3 and the fourth sheet conveying passage R4 in order to the first sheet conveying passage R1.

Figure 5A:
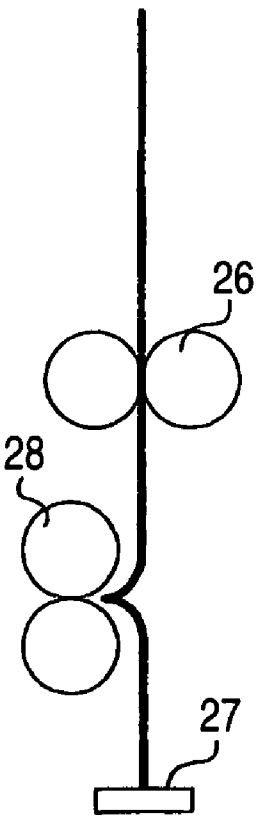
FIGS. 5A, 5B, 5C, and 5D are views showing a procedure of the sheet folding operation according to the embodiment.

Also, the sheet fed into the second sheet conveying passage R2 by the switching gate 24 is folded in the following procedure. First of all, the sheet is pushed in by the push-in rolls 26 in a state where the leading edge of the sheet is stopped by the stopper 27 on the second sheet conveying passage R2. As a result, the sheet is deformed (buckled) like a loop in a neighboring space of the folding rolls 28, and folded at the first crease position by drawing in and nipping its loop part between the folding rolls 28, as shown in FIG. 5A.

Figure 5B:
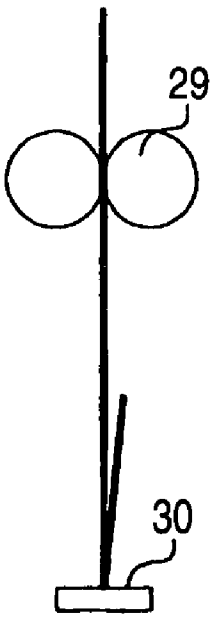
Figure 5C:
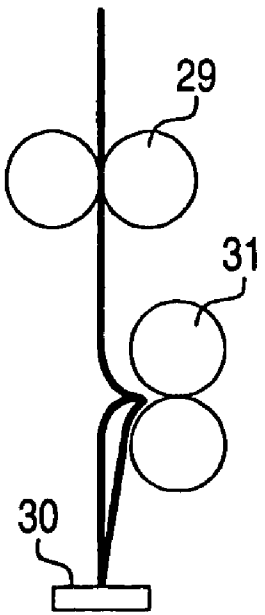

Next, the sheet folded by the folding rolls 28 is conveyed while being nipped between the push-in rolls 29, so that the leading edge of the sheet is stopped by the stopper 30 on the third sheet conveying passage R3, as shown in FIG. 5B. Further, the sheet is pushed in by the push-in rolls 26 from this state, deformed like a loop in a neighboring space of the folding rolls 31, and folded at the second crease position by drawing in and nipping its loop part between the folding rolls 31, as shown in FIG. 5C.

Figure 5D:
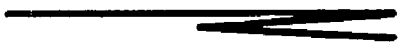

In this case, the first crease position is set at a position one-fourth the original sheet length from the leading edge of the sheet stopped by the stopper 27 in the first sheet folding part 16, and the second crease position is set at a position one-fourth the original sheet length from the leading edge (first crease) of the sheet stopped by the stopper 30 in the second sheet folding part 17, whereby the first crease occurs at the position one-fourth the original sheet length from the sheet end and the second crease occurs at the position half the original sheet length from the sheet end. Consequently, the sheet Z-folded in half the original sheet length is exhausted from the folding rolls 31, as shown in FIG. 5D. Thus, the Z-folded sheet is returned through the fourth sheet conveying passage R4 to the first sheet conveying passage R1. Accordingly, when the sheet Z-folded in the former stage post-processing unit 6 (Z-folded sheet) is fed into the latter stage post-processing unit 7, the folded part of the Z-folded sheet is sent out in a state directed downstream in the sheet conveying direction, and the folded part of the Z-folded sheet is sent out in a state facing down (face-down state) in the vertical direction.

Figure 6:
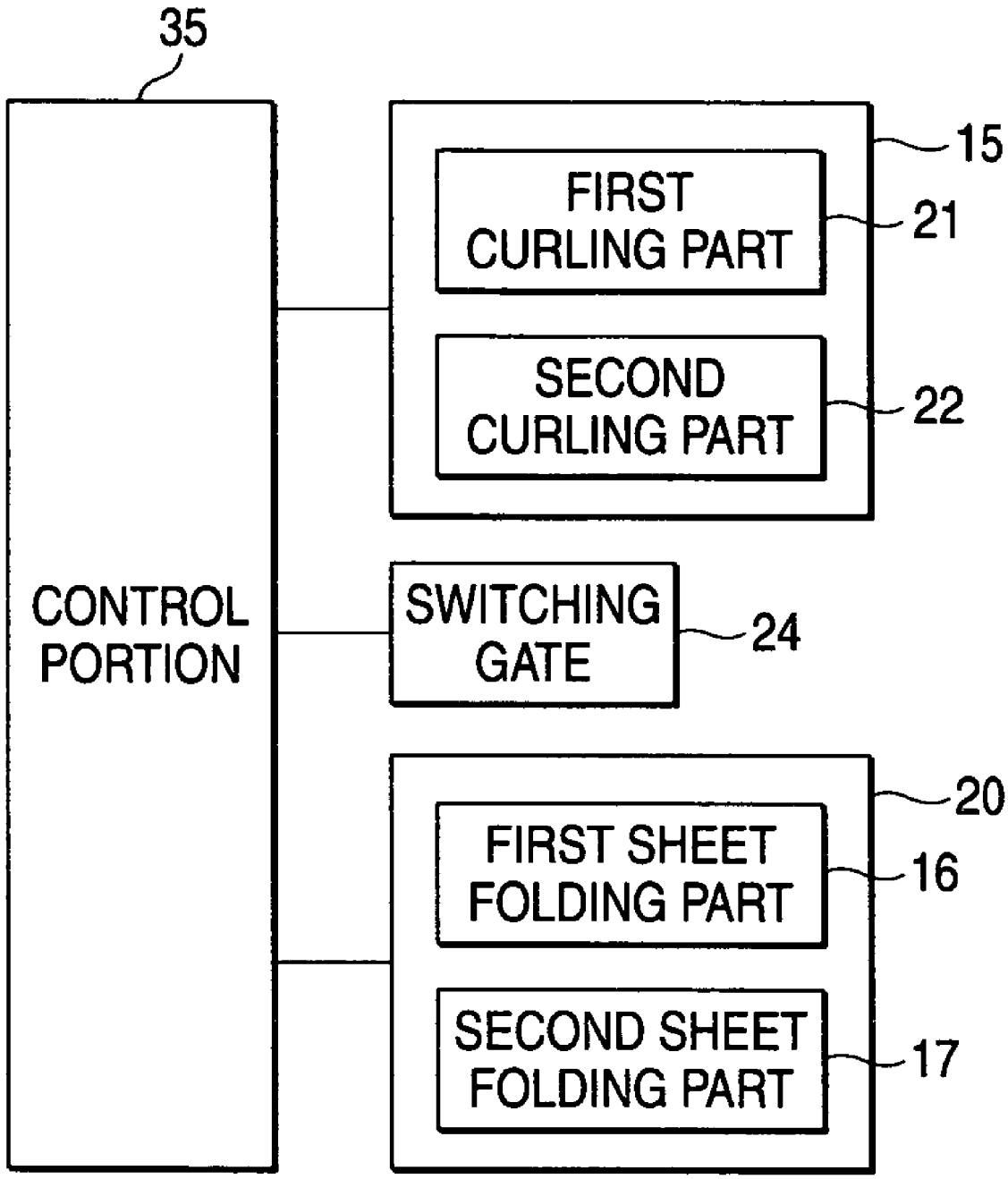
FIG. 6 is a block diagram showing a schematic configuration example of a part of an apparatus control system according to the embodiment.

The operation of the curling mechanism 15 and the sheet folding mechanism 20 is controlled along with the operation of the switching gate 24 by a control unit 35 as shown in FIG. 6. A specific example of the operation control by the control unit 35 will be described below.

Figure 7:
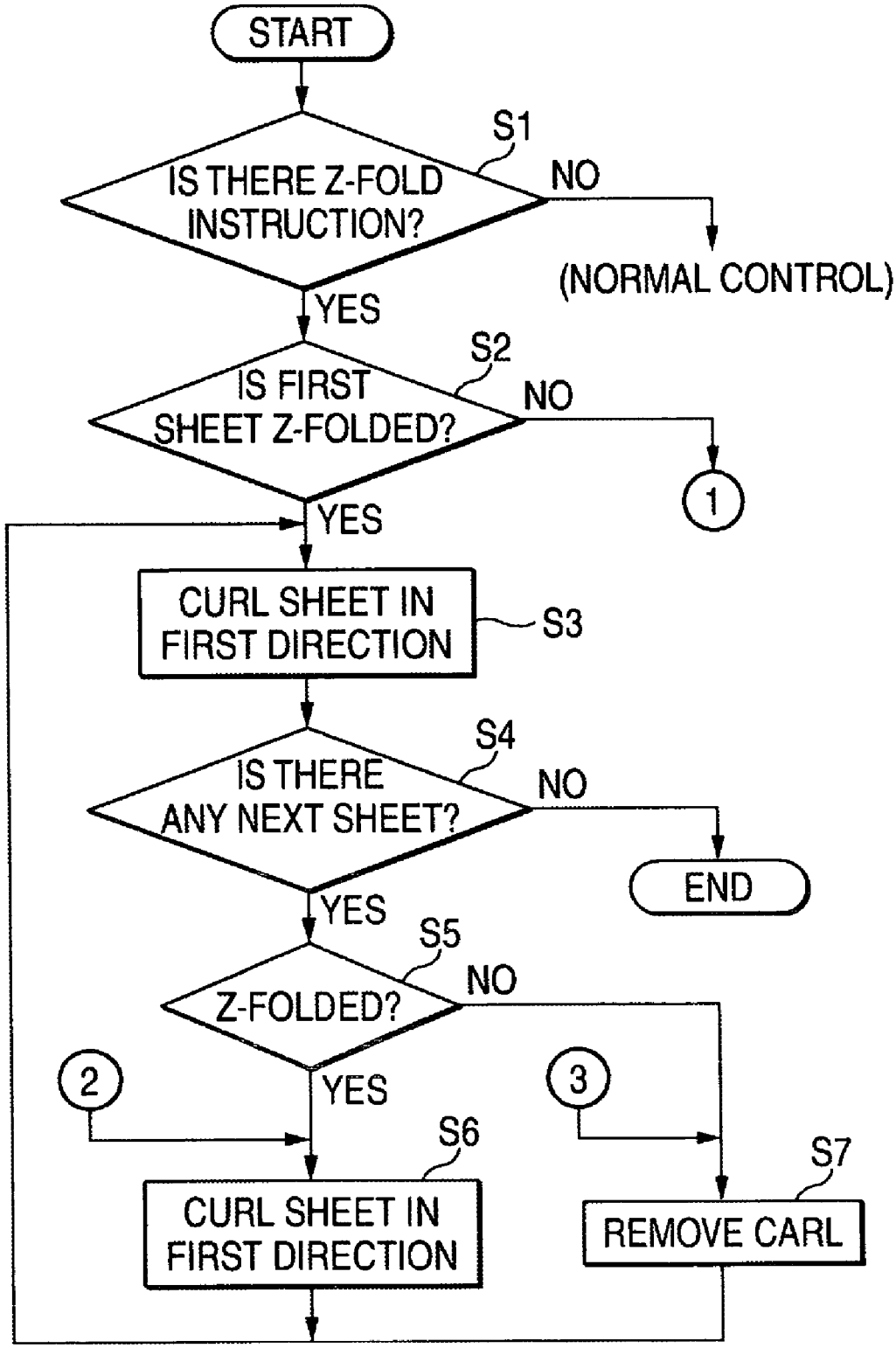
FIG. 7 is a flowchart (No. 1) applied to the operation control of the curling mechanism according to the embodiment.
Figure 8:
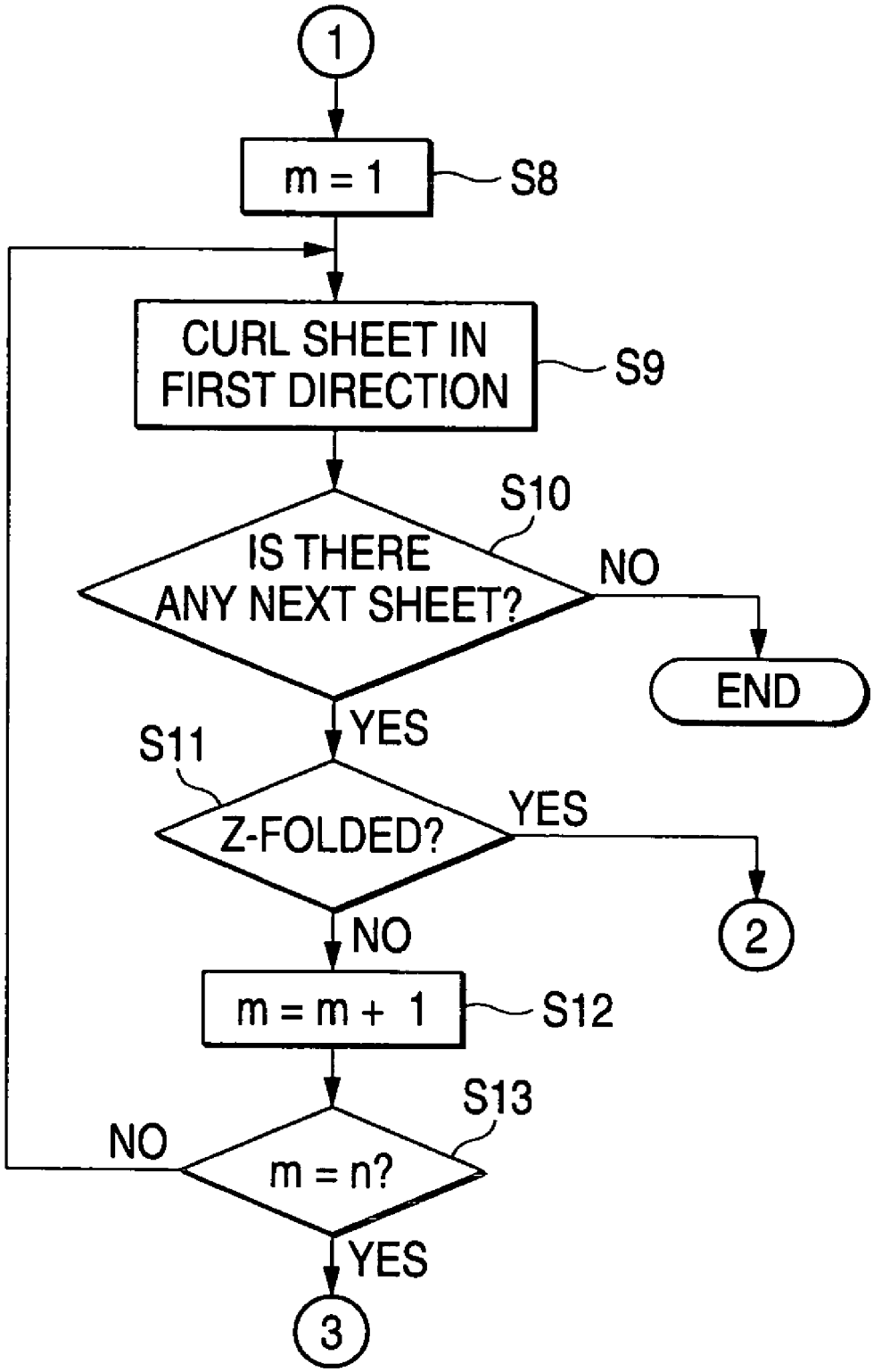
FIG. 8 is a flowchart (No. 2) applied to the operation control of the curling mechanism according to the embodiment.

FIGS. 7 and 8 are flowcharts that are applied to the operation control of the curling mechanism 15. First of all, if a job is started, it is judged whether or not a Z-fold (folding process) instruction is included within a set of the job (step S1). And if the Z-fold instruction is not included, the operation makes a transition to a preset normal control mode (its details being omitted). Also, if the Z-fold instruction is included, it is judged that the first sheet of the job set is subjected to Z-fold (folding process) (step S2). If it is subjected to Z-fold, the curling mechanism 15 is placed in the first operative state, whereby the first sheet is substantially curled in the first direction (with the lower convex shape at the time of outputting the sheet) (step S3).

Subsequently, it is checked whether or not there is any next sheet (step S4). If there is the next sheet, it is judged whether or not its sheet is subjected to Z-fold (step S5). If the next sheet is subjected to Z-fold, the curling mechanism 15 is placed in the first operative state, whereby the sheet is curled in the first direction (step S6). Also, if the next sheet is not subjected to Z-fold, the curling mechanism 15 is placed in the third operative state, whereby the sheet is curled in the first and second directions in turn to remove the curl from the sheet (step S7). In the following, the processing from step S4 is repeated until there is no next sheet.

On the other hand, if the first sheet is not subjected to Z-fold at step S2, the value of variable m is initialized (m=1) (step S8), and then the curling mechanism 15 is placed in the first-operative state, whereby the sheet is curled in the first direction (step S9). Then, it is checked whether or not there is any next sheet (step S10). If there is the next sheet, it is judged whether or not the sheet is subjected to Z-fold (step S11). And if the next sheet is subjected to Z-fold, the operation transfers to step S6, where the sheet is curled in the first direction. Also, if the next sheet is not subjected to Z-fold, the value of variable m is incremented by one (step S12). And it is judged whether or not the value of variable m reaches a preset value n (n is a natural number) (step S13). And if the condition of m=n is not satisfied (in the case of m<n), the procedure returns to step S9. Also, if the condition of m=n is satisfied, the operation transfers to step 37 to remove the curl from the sheet. In the image forming apparatus according to this embodiment, the preset value n can be set arbitrarily.

Figure 9:
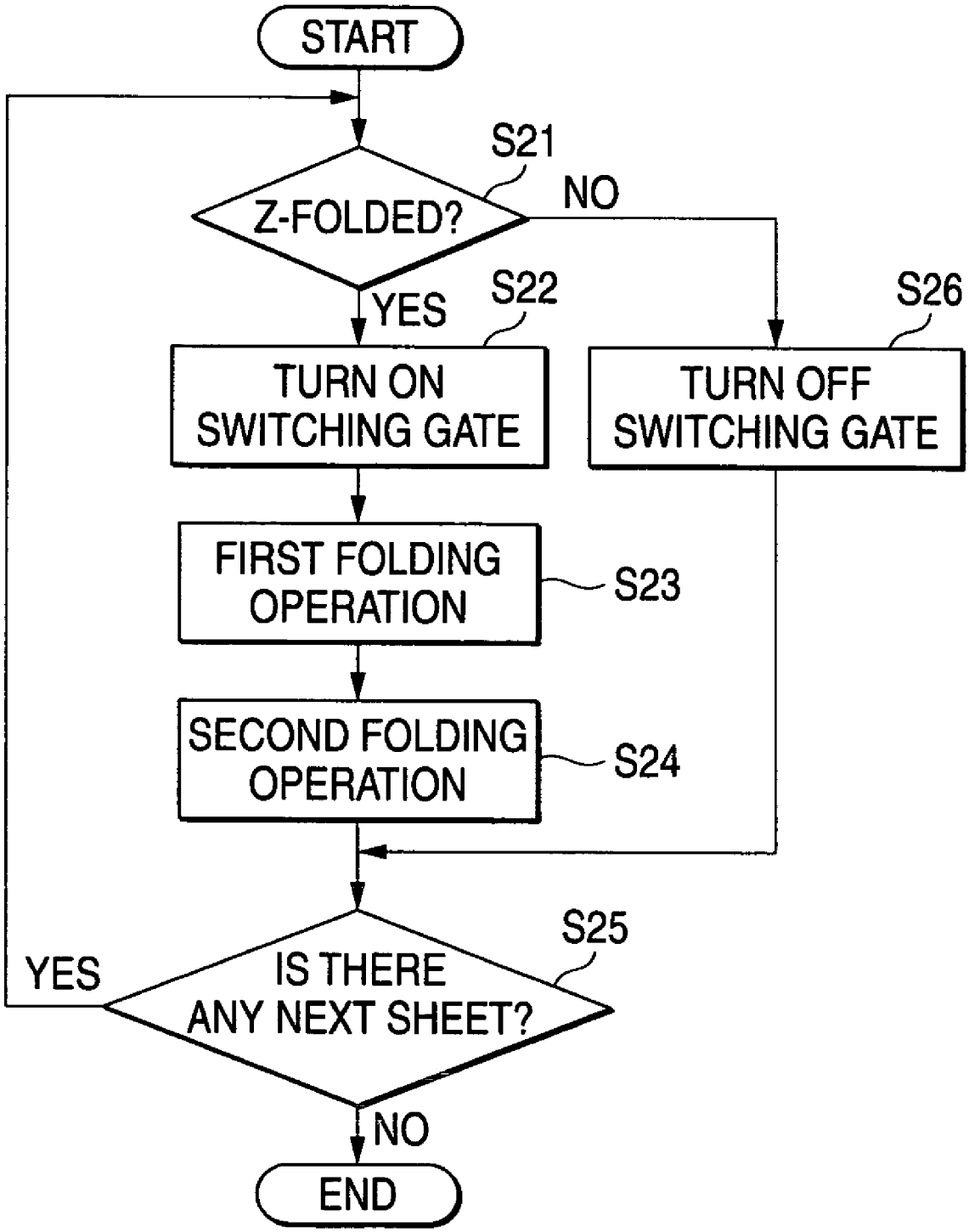
FIG. 9 is a flowchart applied to the operation control of the former stage post-processing unit including the sheet folding mechanism according to the embodiment.

FIG. 9 is a flowchart that is applied to the operation control of the former stage post-processing unit 6 comprising the sheet folding mechanism 20. First of all, if the job is started, it is judged whether or not the sheet (current sheet) sent out from the connection unit 5 to the former stage post-processing unit 6 is subjected to Z-fold (folding process) (step S21). And if the sheet is subjected to Z-fold, the switching gate 24 is turned on, whereby the sheet conveyed by the conveying rolls 23 is led from the first sheet conveying passage R1 to the second sheet conveying passage R2 (step S22).

Next, the first sheet folding part 16 is activated to fold the sheet at the first crease position (step S23). Then, the second sheet folding part 17 is activated to fold the sheet at the second crease position (step S24). With this two stage folding operation, the sheet is Z-folded. Also, the Z-folded sheet is returned through the fourth sheet conveying passage R4 to the first sheet conveying passage R1.

Thereafter, it is checked whether or not there is any next sheet (step S25). If there is the next sheet, the procedure returns to the step S21. Also, if the sheet is not subjected to Z-fold at step S21, the switching gate 24 is turned off to convey the sheet along the first sheet conveying passage R1 horizontally with the upstream conveying rolls 23 and the downstream conveying rolls 25 (step S26). In this case, the sheet is sent out to the latter stage post-processing unit 7 without being Z-folded (folding process) in the former stage post-processing unit 6.

In the image forming apparatus 1 according to the embodiment of the invention, in the case where the sheet on which the image is formed by the image forming unit 4 is fed via the connection unit 5 to the former stage post-processing unit 6, and folded (Z-folded) by the sheet folding mechanism 20 within the former stage post-processing unit 6, the sheet is substantially curled in the first direction (with the lower convex shape at the time of outputting the sheet) by the curling mechanism 15 within the connection unit 5 prior to the Z-folding, and then Z-folded in the sheet folding machine 20.

Figure 10A:
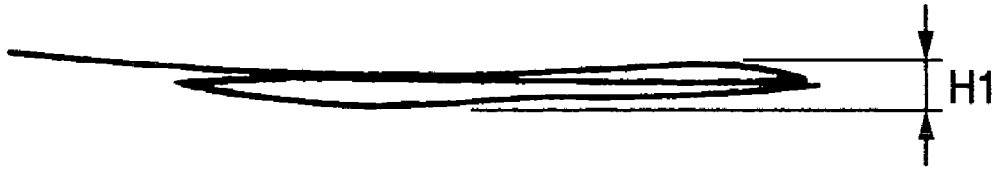
FIG. 10A, 10B, and 10C show attitudes of sheet when the folded sheet is outputted onto the sheet stack tray according to the embodiment.
Figure 10B:
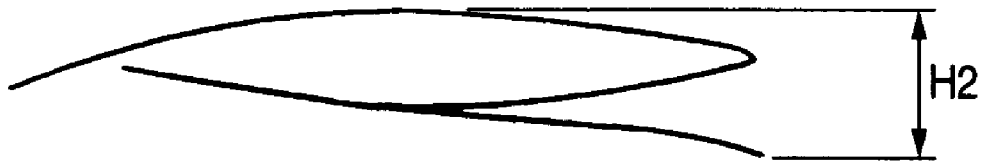
Figure 10C:
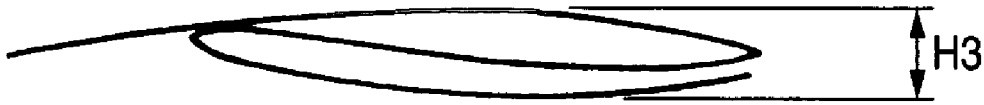

FIGS. 10A, 10B, and 10C show attitudes of the sheet which is folded by the sheet folding mechanism 20 at the time of exhausting the sheet onto the sheet stack tray 19. Among them, FIG. 10A shows an attitude in which the sheet is curled in the first direction by the curling mechanism 15 and Z-folded by the sheet folding mechanism 20. FIG. 10B shows an attitude in which the sheet is curled in the second direction by the curling mechanism 15 and Z-folded by the sheet folding mechanism 20. FIG. 10C shows an attitude in which the sheet is uncurled by the curling mechanism 15 and Z-folded by the sheet folding mechanism 20.

Comparing the stack heights per sheet, the sheet stack height where the sheet is curled in the first direction and Z-folded is H1, and the sheet stack height where the sheet is curled in the second direction and Z-folded is H2 higher than H1, as shown in FIG. 10. Also, the sheet stack height where the sheet is uncurled and Z-folded is H3 higher than H1 and lower than H2. In this way, a main reason why there is a difference in the sheet stack height is that the sheet is curled in the first direction before the folding process (Z-fold) for the sheet, whereby a bulge in the folded part of the Z-folded sheet is suppressed and the height of the sheet top face on the sheet stack tray 19 is suppressed to be lower. In this way, since the sheet stack height on the sheet stack tray 19 is suppressed to be low, the permissible number of sheets that can be outputted onto the sheet stack tray is increased in one job when a job including the Z-folded sheets is processed.

Moreover, in the image forming apparatus 1 according to the embodiment of the invention, in the case where a mix job (mixed job) in which the sheet subjected to Z-fold and the sheet not subjected to Z-fold are mixed in one job set is performed, if the first sheet sent to the connection unit 5 is not subjected to Z-fold, the sheet is curled in the first direction and the second and subsequent sheets are curled in the first direction until the number of sheets not subjected to Z-fold reaches a predetermined number (n sheets) or the sheet subjected to Z-fold is conveyed.

Though in the above embodiment, the invention is applied to the image forming apparatus 1 that is made up of a combination of the image forming apparatus main body 2 and the post-processing apparatus main body 3, the invention is not limited to the above embodiment, but the invention maybe applied to the post-processing apparatus alone. Also, this invention may be implemented as an image forming method and a post-processing method based on the flowcharts of FIGS. 7 to 9.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a sheet;

a curling unit that curls the sheet on which the image is formed;

a sheet folding unit that performs a folding process for the sheet on which the image is formed; and a control unit that controls an operation of the curling unit and the sheet folding unit so that the sheet on which the image is formed is substantially curled in a first direction to be folded, wherein the sheet folding unit z-folds the sheet on which the image is formed as the folding process, and the control unit is configured to control the curling unit to curl a first sheet in the first direction when performing a mixed job in which the first sheet is not subjected to the folding process and at least one of following sheets is subjected to the folding process.

2. The image forming apparatus according to claim 1, wherein the control unit controls the curling unit to curl sheets following the first sheet when the first sheet and the following sheets are not subjected to the folding process in the mixed job.

3. The image forming apparatus according to claim 2, wherein the control unit controls, if the number of sheets following the first sheet exceeds n−1 where n denotes a natural number more than 2, the curling unit to remove the curl from the $n^{th}$ sheet which is not subjected to the folding process.

4. The image forming apparatus of claim 1, wherein the curling unit comprises a first pair of pressure rolls and a second pair of pressure rolls, and the control unit controls the operation of the curling unit and the sheet folding unit so that the sheet may undergo any one of the following combinations of curling:

curled by neither the first nor second pair of pressure rolls;

curled by the first pair of pressure rolls only;

curled by the second pair of pressure rolls only; and curled by both the first and second pairs of pressure rolls.

5. The image forming apparatus of claim 4, wherein the curling unit is configured to remove curl from the sheet.

6. The image forming apparatus of claim 1, wherein the sheet folding unit comprises:

a first sheet folding part that folds the sheet at a first crease position; and a second sheet folding part that folds the sheet at a second crease position, and wherein the sheet folding unit z-folds the sheet by folding at the first crease position and the second crease position as the folding process.

7. A post-processing apparatus comprising:

a curling unit that curls a sheet;

a sheet folding unit that performs a folding process for the sheet; and a control unit that controls an operation of the curling unit and the sheet folding unit so that the curling unit substantially curls the sheet in a first direction, and that the sheet folding unit performs the folding process, wherein the sheet folding unit is capable of selectively z-folding the sheet, and the control unit is configured to control the curling unit to curl a first sheet in the first direction when performing a mixed job in which the first sheet is not subjected to the folding process and at least one of following sheets is subjected to the folding process.

8. The post-processing apparatus of claim 7, wherein the curling unit comprises:

a first pair of pressure rolls selectively capable of curling the sheet in a first direction to be folded; and a second pair of pressure rolls selectively capable of curling the sheet in a second direction to be folded opposite to the first direction to be folded.

9. The post-processing apparatus of claim 8, wherein the control unit controls the operation of the curling unit and the sheet folding unit so that the sheet may undergo any one of the following combinations of curling:

curled by neither the first nor second pair of pressure rolls;

curled by the first pair of pressure rolls only;

curled by the second pair of pressure rolls only; and curled by both the first and second pairs of pressure rolls.

10. The image forming apparatus of claim 7, wherein the sheet folding unit comprises:

a first sheet folding part that folds the sheet at a first crease position; and a second sheet folding part that folds the sheet at a second crease position, and wherein the sheet folding unit z-folds the sheet by folding at the first crease position and the second crease position as the folding process.

11. An image forming method comprising:

performing a mixed job in which a first sheet is not subjected to a z-folding process and at least one of following sheets is subjected to the z-folding process;

forming an image on the sheet that subjected to the z-folding process;

curling the sheet on which the image is formed in a first direction when performing the mixed job; and performing the z-folding process on the curled sheet that is subjected to the z-folding process.

12. A post-processing method comprising:

performing a mixed job in which a first sheet is not subjected to a z-folding process and another sheet is subjected to the z-folding process;

curling the sheet subjected to the z-folding process in a first direction when performing the mixed job; and performing the z-folding process on the curled sheet which is subjected to the z-folding process.

* * * * *